US005346327A

United States Patent [19]

Herbert

[11] Patent Number: 5,346,327

[45] Date of Patent: Sep. 13, 1994

[54] SPRINGY FASTENER HELD OPEN BY A MELTABLE MATERIAL

[76] Inventor: Edward Herbert, 1 Dyer Cemetery Rd., Canton, Conn. 06019-2029

[21] Appl. No.: 974,847

[22] Filed: Nov. 10, 1992

[51] Int. Cl.[5] ..... H01R 4/10; H01R 4/48

[52] U.S. Cl. ..... 403/272; 228/191; 29/869; 29/517; 29/518; 439/874

[58] Field of Search ..... 403/272, 270, 271, 265; 228/255, 132, 191; 29/869, 446, 447, 516, 517, 518; 439/161, 736, 790, 874; 174/84 R, 90, 94 R

[56] References Cited

U.S. PATENT DOCUMENTS

| | | | |
|---|---|---|---|
| 277,478 | 5/1883 | Grinnell | 403/272 |
| 433,591 | 8/1890 | Blakey | 403/272 |
| 2,109,517 | 3/1938 | Xenis . | |
| 2,972,657 | 2/1961 | Stemke | 174/84 R |
| 3,243,211 | 3/1966 | Metmore | 439/874 |
| 3,247,315 | 4/1966 | Miller | 174/90 |
| 4,092,193 | 5/1978 | Brooks | 174/DIG. 8 |
| 4,221,457 | 9/1980 | Allen et al. | 439/874 |
| 4,631,098 | 12/1986 | Pithouse et al. | 174/DIG. 8 |
| 4,972,880 | 11/1990 | Strand | 174/DIG. 8 |

FOREIGN PATENT DOCUMENTS

| | | | |
|---|---|---|---|
| 2937749 | 3/1981 | Fed. Rep. of Germany | 174/DIG. 8 |
| 0195668 | 8/1990 | Japan | 439/161 |

*Primary Examiner*—P. Austin Bradley
*Assistant Examiner*—Erik R. Puknys

[57] ABSTRACT

A fastener for splicing wires and the like is mace by forming a tubular sleeve of spring material such as phosphor bronze. In its unrestrained shape, the tubular sleeve is too small to receive the wires, but the tubular sleeve is expanded elastically and held expanded by solder, so that the wires can be inserted. Upon the application of heat the solder melts, flowing into the joint and allowing the sleeve to spring back to its original size or at least to the diameter of the wires. The fastener can be mounted on a stud to provide a replacement for the familiar solder cup terminal. An expanded sleeve can be placed around a piece of heat shrinkable tube. When heated, the tube and the sleeve contract, the sleeve reinforcing the tube giving a much greater compressive force during shrinking. The sleeve then becomes a metallic protector for the tube.

9 Claims, 3 Drawing Sheets

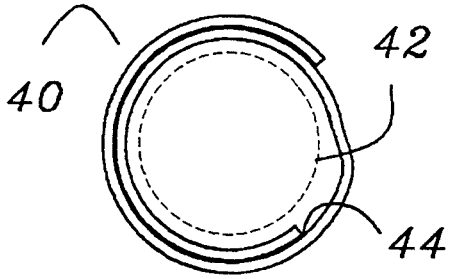
Fig. 8
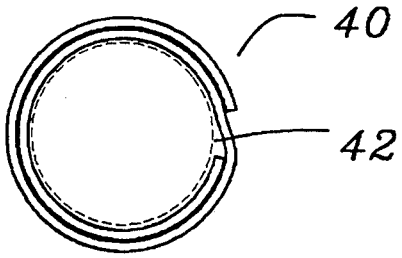
Fig. 9
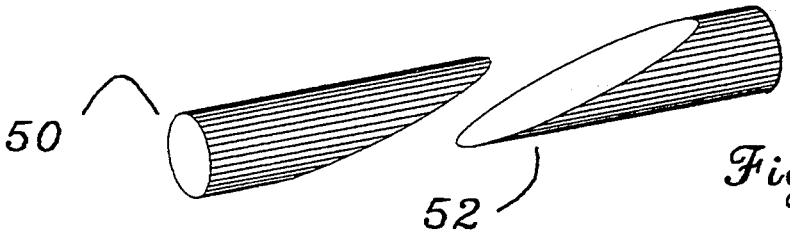
Fig. 10
Fig. 11
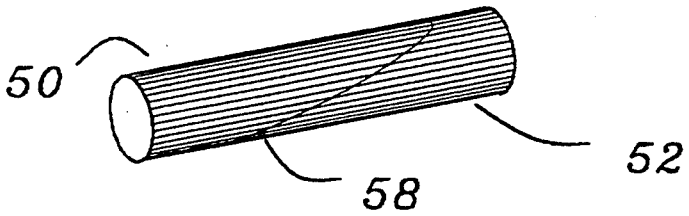
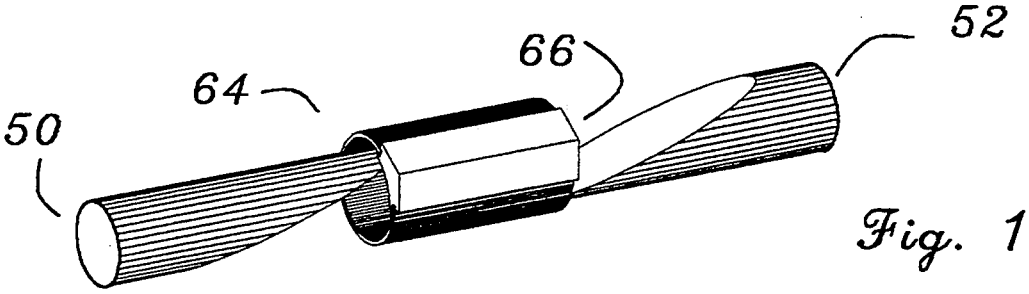
Fig. 12
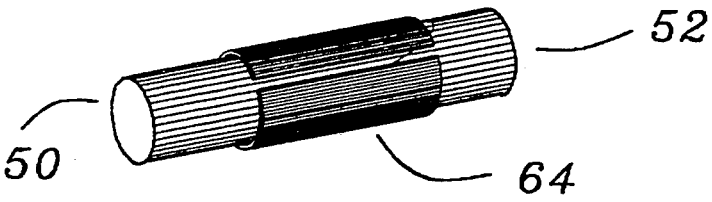
Fig. 13

SPRINGY FASTENER HELD OPEN BY A MELTABLE MATERIAL

BACKGROUND OF THE INVENTION

This invention relates generally to fasteners for splicing wires or the like, or for terminating wires at a terminal.

Often wires are joined by a crimp connection or a solder connection. The connector must be oversized to allow the wire to be slipped in easily, making a bulky discontinuity in the diameter of the wire. Where a large number of connections must be made in the same general location, the bulk of the connectors, with the space required between them, can be substantial.

It is an object of this invention to provide a fastening means which adds minimally to the diameter of the wire being connected.

It is a further object of this invention to provide a fastening means which is easily applied with simple tools, and provides a tightly soldered connection.

BRIEF DESCRIPTION OF THE DRAWINGS

FIGS. 8 and 9 show an alternate section for the fastener of FIGS. 4 through 7.

FIG. 10 shows two wires prepared by tapering their ends.

FIG. 11 shows the wires of FIG. 10 when joined.

FIGS. 12 and 13 show the wires of FIG. 19 with the fastener of FIG. 2, before and after joining them.

DESCRIPTION OF THE PREFERRED EMBODIMENTS

Figure 1:
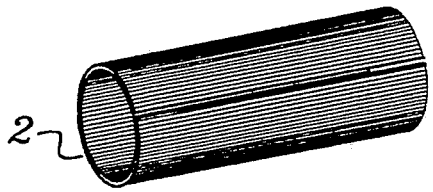
FIG. 1 shows a fastener in its natural shape.

FIG. 1 shows a tubular sleeve 2 such as could be made by rolling up a strip, or by slitting a tube. The material used to make the sleeve should be springy, that is, it should be capable of being elastically deformed, returning to the original unrestrained shape when the deforming force is removed. For use as a wire splice, the tubular sleeve 2 is preferably made of a springy metal such as beryllium copper or phosphor bronze, but even a relatively soft material such as copper (work hardened) would suffice for some applications.

Figure 2:
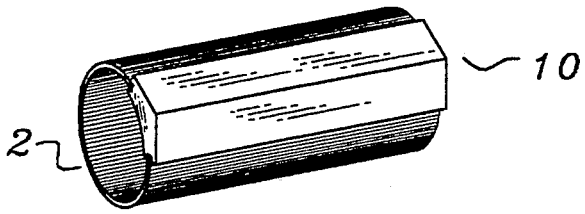
FIG. 2 shows the fastener held open by a wedge of solder.

FIG. 2 shows a fastener comprising the tubular metal sleeve 2 of FIG. 1 elastically deformed so as to have a larger diameter. A wedge 10 has been inserted into the open side of the deformed tubular metal sleeve 2 to retain the sleeve 2 in the deformed shape. The wedge 10 is made of a meltable material such as solder.

Figure 3:
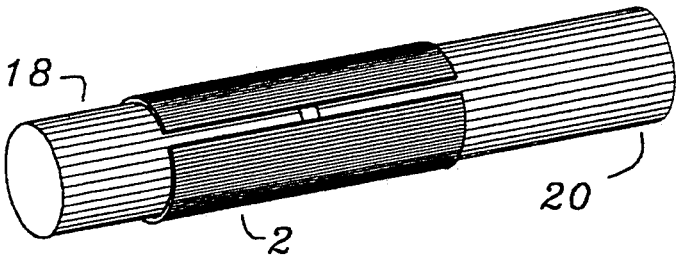
FIG. 3 shows the fastener connecting two wires.

Two wires 18 and 20 to be connected are inserted into the fastener 2, one in each end, then the fastener 2 is heated, as with a soldering iron. The result is as shown in FIG. 3. The fastener 2 has returned partially to the unrestrained shape, engaging the wires 18 and 20, as the wedge 10 melted. When the wedge 10 is melted, the solder of which it was made flows into the joint between the fastener 2 and the wires 18 and 20, joining them.

For a more general purpose description of the invention, the tubular sleeve 2 of FIG. 1 could be made of any springy material, including but not limited to metals, certain rigid plastics, composite materials, and so forth. The precise geometry of the tubular sleeve 2 of FIG. 1 is not limited either, as long as it has an unrestrained shape which would interfere with the member or members to be received, and has a deformed shape which allows the member or members to be received. The sleeve 2 could have other features, for instance having the edges of the cut be toothed or scalloped in a complementary manner so that the cut would not pass a stray strand as from a stranded wire, or the cut in the tubular sleeve could be a helix.

The second part 10, as an alternative to the wedge 10 could be any other geometry or arrangement which holds the tube in the deformed state, as long as it is made of meltable material.

"Meltable" is used to describe any change of state from one where the second part 10 is sufficiently solid and strong to retain the sleeve 2 in the deformed state to another more relaxed state which allows the sleeve 2 to return at least partially to the unrestrained state. It could be a solder as described above, with the solder flowing into the joint to join the several parts. It could also be a thermoplastic adhesive, which would serve a comparable function. This could be used, for example, in splicing ropes or wooden dowels.

The point of novelty of the invention does not rely in any way on the nature of the members to be joined, nor upon the geometry or nature of the parts which may extend from the members which the fastener receives and engages. In many cases, one or more wires would be joined, but it could be parts of any size, shape or nature provided that suitable appendages are built into or affixed to the parts.

The meltable second part 10 could alternatively flow away or dissipate, serving no further function once it had been melted. The clamping force of the springy material may provide sufficient engagement for some applications, particularly if the tubular sleeve 2 has features to enhance the grip of the tubular sleeve 2 where it contacts the member or members when engaged, such as teeth, barbs, knurls, or other friction enhancing shape or coating.

The meltable second part 10 could also be made of a solid flux material such as rosin. Upon melting, it would flow into the joint, applying flux the sleeve and the wires and preparing them for soldering. Solder could then be applied as a separate next operation in the assembly process. Alternative, if the wires and/or the sleeve had a heavy solder plate, the solder plate would fellow to fill the joint.

Figure 4:
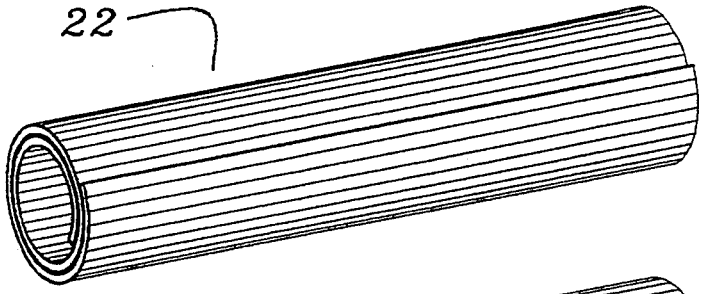
FIG. 4 shows a fastener in its natural shape

FIG. 4 shows an alternative to the sleeve 2 of FIG. 1. A fastener comprising a sleeve 22 of springy material in the form of a tubular spiral could be made by rolling up tightly a strip of metal or other material. As shown in FIG. 4, the tubular spiral has somewhat more than two complete turns giving a circumferential arc of somewhat more than 720 degrees. There is a longitudinal overlap between the coils of the tubular spiral of somewhat more than 360 degrees.

Figure 5:
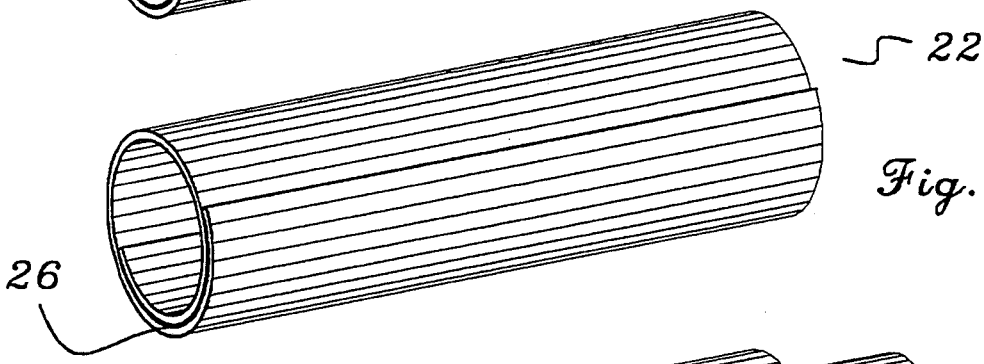
FIG. 5 shows the fastener expanded. The overlap is soldered.

FIG. 5 shows a fastener comprising the sleeve 22 of FIG. 4 elastically deformed diametrically. When expanded to the deformed shape, the circumferential arc of the tubular spiral is changed as the diameter increases. As illustrated, the deformed circumferential arc is about 520 degrees, and the circumferential arc of the longitudinal overlap is about 180 degrees.

Solder 26 is applied to the sleeve 22, flowing into the longitudinal overlap and bonding to the sleeve 22 within the longitudinal overlap to retain the sleeve 22 in the deformed shape. The amount of solder 26 may be just the amount sufficient to retain the sleeve 22 in the deformed shape, or it may be a piece having thicker section to provide additional solder so that upon melting there will sufficient solder to flow into the joint.

Figure 6:
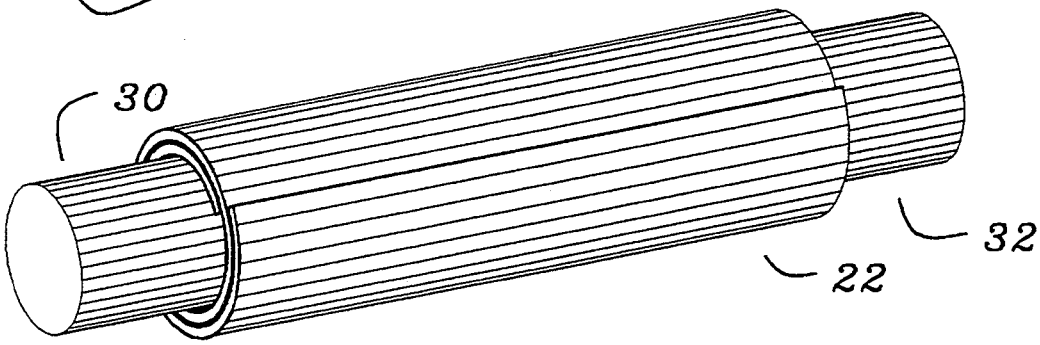
FIG. 6 shows the fastener connecting two wires.

FIG. 6 shows a fastener comprising the sleeve 22 of springy material in the form a tubular spiral engaging two wires 30 and 32. Upon melting the meltable second part, for instance the solder 26 of FIG. 5, the sleeve 22 has returned partially to the unrestrained shape, closing down upon the wires 30 and 32, engaging them. The outside diameter of the wires 30 and 32 limits the degree to which the sleeve 22 can return partially to the unrestrained shape.

Figure 7:
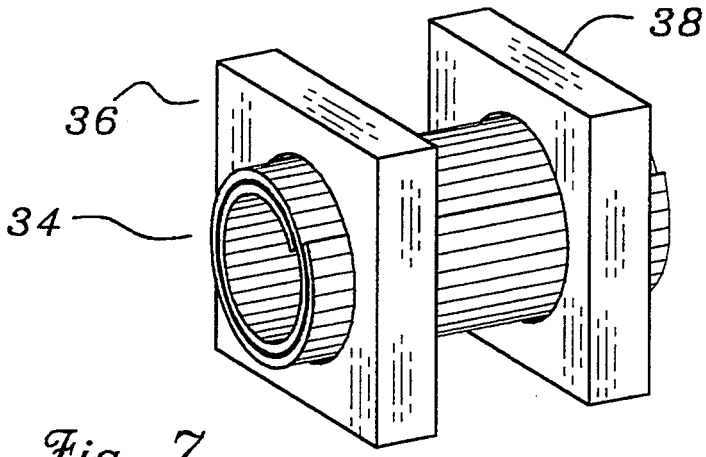
FIG. 7 shows two terminals connected by a fastener.

FIG. 7 shows a fastener comprising a sleeve 34 of springy material in the form of a tubular spiral engaging two members 36 and 38. In this example, the sleeve 34 has an unrestrained shape which is larger that the diameter of the holes in the members 36 and 38, which would interfere with putting the sleeve 34 together with the members 36 and 38. Though not illustrated, the sleeve 34 would have been deformed elastically to a deformed shape which was smaller than the holes in the members 36 and 38 and retained with solder. Upon heating, the solder melts, and the sleeve 34 returns partially to the unrestrained shape, engaging the members 36 and 38 internally as shown.

FIGS. 8 and 9 show that the section of the tubular spiral can be modified to provide better bearing. In FIG. 8, a sleeve 40 has been elastically deformed and retained with solder 44, allowing the sleeve 40 to receive a member 42 without interference. In FIG. 9, the solder has been melted, allowing the sleeve 40 to return at least partially to the unrestrained shape, engaging the member 42.

When used for splicing electrical wires, as in FIGS. 3 or 6, it may be advantageous that the splice have conductivity for electricity at least as good as the wires being spliced, so as not to create excessive losses and localized heating. It may also be desirable to have thermal conductivity at least as good as the wires being spliced, so as not to create excessive temperature rise, if the wire is used for heat sinking.

To assure this in the splices of FIG. 3 or 6, the ends of the wires could be flat and tightly joined, but that is an unrealistic requirement for a general purpose blind splice. Alternatively, the sleeve 2 or 22 could have equivalent conductivity. In most instances, this would require the section of the sleeve 2 or 22 to have a larger area than the wires, because the conductivity of most springy metals is less than that of pure copper, the metal of which most wires are made. For many applications, this would be no particular problem, but for some the bulk of the splice would be undesirable.

FIGS. 10 through 13 offer a solution to the problem of the previous paragraph. In FIG. 10, two wires 50 and 52 have their respective ends cut in complementary tapers. (Stranded wires would preferable be tinned before cutting the taper). Such wires can be mated without a void between them. FIG. 11 shows the two wires 50 and 52 having complementary tapers joined with solder 58. The discontinuity in conductivity is much less than it would be with a butt joint, especially an imperfect one. The shallower the taper, the greater the overlap and the better the joint. Such a joint would be very difficult to make without jigs or fixturing.

FIG. 12 shows a fastener comprising a sleeve 64 retained in the deformed shape by a wedge 66 of solder. Two wires 50 and 52 having complimentary tapered ends can be received into the fastener 64. When heated, as with a soldering iron, the wedge 66 of solder melts, allowing the sleeve 64 to partially return to the unrestrained shape. The solder flows into the joint.

FIG. 13 shows the finished splice. Fastener 64 has engaged the wires 50 and 52, and closed upon them, clamping them together. As in FIG. 11, there is good face to face contact between the complementary tapers of the wires 50 and 52. If there is slight longitudinal misalignment between the ends of the wires 50 and 52, they are none the less clamped tightly together, flat area to flat area, for good conductivity.

In the fastener of FIG. 13, good conductivity through the splice is assured by the mating of complementary tapers and does not rely upon conduction through the sleeve 64 of the fastener. Accordingly, the sleeve 64 can be optimized for other characteristics than conductivity. A strong spring steel such as stainless steel or carbon steel could be used for maximum strength with minimum size.

Complimentary conical tapers could also be used, one male and the other female. The female taper would preferably be slotted to provide some radial compliance to accommodate some variation in penetration. The fastener would bear mostly upon the outside of the member having the female taper, compressing it when melted, with some overlap over the second member. The conical taper has the advantage of rotational freedom of motion during assembly.

Figure 14:
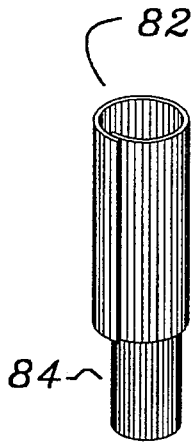
FIG. 14 shows the connector of FIG. 5 mounted on a stud, for use as a terminal.
Figure 15:
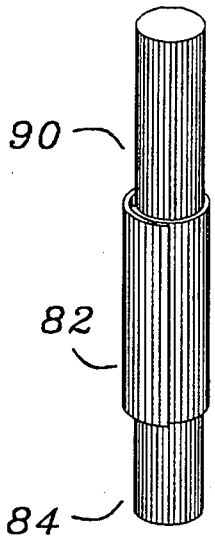
FIG. 15 shows the terminal of FIG. 14 with a wire installed.

FIG. 14 shows a fastener 82 fixedly mounted on a stud 84, which could be an appendage of a larger assembly or the terminal for a wire. FIG. 15 shows the fastener 82 partially returned to the unrestrained shape engaging a wire 90. The fastener of FIGS. 14 and 15 could be a replacement for the familiar solder cup terminal, but could have a smaller outside diameter.

Any of the features of the fasteners described earlier could be incorporated into a terminal design. Other features could be used to modify the terminal design for various applications or to optimize one or another characteristic or feature. Examples are: the stud 84 and the engaged member shown as the wire 90 could be stepped, having a reduced diameter under the fastener 82 so the outer diameter of the whole is essentially even. In the deformed shape, as in FIG. 14, the tubular sleeve 82 could be deformed into a truncated conical shape, so that the bottom of the truncated cone conformed to the outside diameter of the stud 84 while having a more open top to more easily receive the member to be joined. Upon heating, the truncated cone would return partially to its unrestrained shape, which may be cylindrical as shown in FIG. 15, or some taper may remain (perhaps even reversed) depending upon the respective diameters of the stud 84 and the wire 90 which was engaged.

In the above examples, single wires are shown engaging the fastener at each receptacle. Obviously several wires could be received at each. The deformed shape should be large enough to receive the several wires, and the unrestrained shape should engage them.

Figure 16:
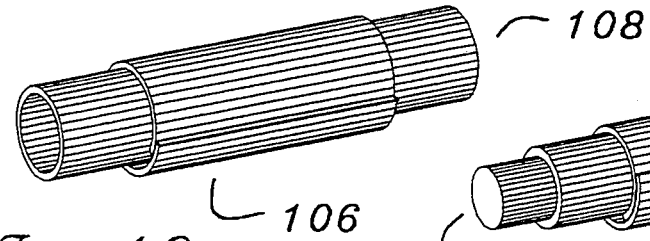
FIG. 16 shows an expanded spiral tube over a length of shrink tubing.

FIG. 16 shows a sleeve 106 in the form of a tubular spiral of springy material. The sleeve has been elastically deformed and retained by solder. The sleeve 106 can be slipped over a piece of shrinkable tubing 108.

Figure 17:
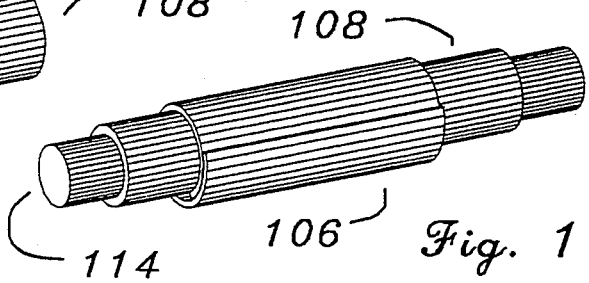
FIG. 17 shows the spiral tube and the shrink tubing of FIG. 16 shrunk over a wire.

FIG. 17 shows the sleeve 106 and shrinkable tubing 108 of FIG. 16 after it has been placed upon a wire 114 and heated. The shrinkable tubing 108 has shrunk around the wire 114, and the sleeve 106 has partially returned to the unrestrained shape around the shrinkable tubing 108. This reinforces the shrinkable tubing 108, providing a much greater compression force during heating, and also provides protection.

I claim:

1. A method of securing at least one member, comprising providing a tube made of a springy material which is restrained in a first diameter by a second material so as to freely receive at least one member, inserting the at least one member into the tube, melting the second material so that the tube is no longer restrained and the tube's diameter is constricted so as to secure the at least one member, wherein the tube comprises a first lengthwise edge and a second lengthwise edge, and the second material is in the form of a wedge and is positioned to fit between the first and second lengthwise edges of the tube so as to force open the tube into a diameter larger than its unrestrained diameter.

2. A method of securing at least one member, comprising providing a tube made of a springy material which is restrained in a first diameter by a second material so as to freely receive at least one member, inserting the at least one member into the tube, melting the second material so that the tube is no longer restrained and the tube's diameter is constricted so as to secure the at least one member, wherein the tube comprises a first lengthwise edge and a second lengthwise edge which said edges overlap, and the second material is positioned to fit within the overlap of the first and second lengthwise edges of the tube so as to force open the tube into a diameter larger than its unrestrained diameter.

3. The method of claim 1, further comprising the at least one member is a mounting stud and the tube fixes the mounting stud to a second member so that the mounting stud and the tube function as a terminal to receive the second member.

4. The method of claim 1, further comprising a first and second member, each member having a taper, mating and attaching the members with the tube such that there is no void between the tapers of the first and second members.

5. The method of claim 1, further comprising in combination, a shrinkable tubing and a wire, wherein the shrinkable tubing may be slipped over the wire and heated to shrink around the wire, whereby the first tube of springy material provides additional protection and a greater compression to the combination.

6. The method of claim 2, further comprising the at least one member is a mounting stud and the tube fixes the mounting stud to a second member so that the mounting stud and the tube function as a terminal to receive the second member.

7. The method of claim 2, further comprising a first and second member, each member having a taper, mating and attaching the members with the tube such that there is no void between the tapers of the first and second members.

8. The method of claim 2, further comprising in combination, a shrinkable tubing and a wire, wherein the shrinkable tubing may be slipped over the wire and heated to shrink around the wire, whereby the first tube of springy material provides additional protection and a greater compression to the combination.

9. A method of engaging at least one member, comprising providing a tube made of a springy material which is restrained in a first diameter smaller than its unrestrained diameter by a second material, inserting the tube into a member having a hole larger than the restrained diameter of the tube but smaller than its unrestrained diameter, melting the second material so that the tube is no longer restrained and the tube's diameter increases so as to be secured in the hole of the member, wherein the tube comprises a first lengthwise edge and a second lengthwise edge which said edges overlap, and the second material is positioned to fit within the overlap of the first and second lengthwise edges of the tube so as to keep the tube at a diameter smaller than its unrestrained diameter.

* * * * *